US005379913A

United States Patent [19]

Rieke et al.

[11] Patent Number: 5,379,913

[45] Date of Patent: Jan. 10, 1995

[54] FLANGE EXTENSION FOR EXTERNALLY DETACHABLE DRUM LINER

[75] Inventors: Todd M. Rieke; David S. Rieke, both of Auburn, Ind.

[73] Assignee: Rieke Corporation, Auburn, Ind.

[21] Appl. No.: 987,198

[22] Filed: Dec. 8, 1992

[51] Int. Cl.[6] ..... B65D 25/16

[52] U.S. Cl. ..... 220/601; 220/465

[58] Field of Search ..... 220/465, 601, DIG. 1, 220/403, 404, 461

[56] References Cited

U.S. PATENT DOCUMENTS

| | | | |
|---|---|---|---|
| 583,676 | 6/1897 | Emery | 220/465 |
| 2,103,678 | 12/1937 | Kline et al. | 220/465 |
| 2,224,632 | 12/1940 | Giles | 220/DIG. 1 |
| 2,338,604 | 1/1944 | Silveyra . | |
| 2,987,216 | 6/1961 | Fletcher . | |
| 2,989,208 | 6/1961 | Gibbs, Jr. . | |
| 3,167,210 | 1/1965 | Carney, Jr. . | |
| 3,219,230 | 11/1965 | Housz et al. . | |
| 3,432,070 | 3/1969 | Carpenter, Jr. et al. . | |
| 3,443,735 | 5/1969 | Meijers . | |
| 3,698,595 | 10/1972 | Gortz et al. . | |
| 3,918,605 | 11/1975 | Butler . | |
| 3,924,773 | 12/1975 | Wilkinson | 220/465 |
| 4,164,304 | 8/1979 | Roberson . | |
| 4,548,338 | 10/1985 | Sander | 220/465 |
| 4,552,166 | 11/1985 | Chadbourne, Sr. et al. . | |
| 4,635,814 | 1/1987 | Jones . | |
| 4,653,663 | 3/1987 | Holtsclaw . | |
| 4,759,459 | 7/1988 | Bailey et al. . | |
| 4,775,073 | 10/1988 | Webb . | |
| 4,941,584 | 7/1990 | Bowers et al. | 220/465 |
| 4,993,579 | 2/1991 | Burchett . | |
| 5,005,726 | 4/1991 | Robbins . | |
| 5,046,634 | 9/1991 | McFarlin et al. . | |
| 5,056,680 | 10/1991 | Sharp . | |
| 5,154,308 | 10/1992 | Larson . | |

*Primary Examiner*—Gary E. Elkins
*Assistant Examiner*—S. Castellano
*Attorney, Agent, or Firm*—James M. Durlacher

[57] ABSTRACT

A flange fitting for attaching to the lid of a drum includes a seal tube having a generally cylindrical main body with a relatively thin wall arid an outwardly radiating frustoconical lip extension. Also included as part of the flange fitting is a standard drum plug flange having a generally cylindrical main body and an outwardly radiating, frustoconical lip. The drum plug flange is sized and shaped so as to fit within the seal tube such that the lip extension and the lip are generally coextensive with each other. These two components are then able to be anchored into the lid of the drum through a punch press operation which simultaneously clamps and crimps both the lip and lip extension into a raised boss recess thereby precluding any preassembly, such as by welding, of the seal tube and drum flange prior to assembly to the drum lid.

6 Claims, 5 Drawing Sheets

FLANGE EXTENSION FOR EXTERNALLY DETACHABLE DRUM LINER

BACKGROUND OF THE INVENTION

The present invention relates in general to drum liner technology wherein a barrier film or bag is used to separate the contents within the liner from the drum material. More specifically the present invention relates to a flange extension for use with an externally detachable drum liner.

In a 1992 article by Douglas Larson, published in *The Chemical Packaging Review*, Vol. 2, No. 5, January-February, 1992, pages 32–34 the concept of an externally detachable drum liner (EDDL) was presented. Mr. Larson explains in his article that "EDDL was initially conceived as a method to facilitate the removal of tenacious semi-liquid wastes and sediments characteristic of many of the hazardous waste shipments in 55-gallon steel drums."

The value of EDDL is to enable the longer cycle of reuse for containers that might otherwise reach a point of chemical contamination due to the chemical residue left when the contents of the drum are emptied. If the residue is such that it is classified as a hazardous chemical or hazardous waste, then the chemical residue might result in the 55-gallon drum becoming 55 pounds of contaminated packaging material occupying 55 gallons of volume.

The use of a protective liner which is filled with the chemical (contents of the drum) will trap the residue in the liner leaving the drum clean and uncontaminated. This allows the drum to be handled as "clean" which greatly facilitates and simplifies its reuse or recycling. It is of course important that the liner and liner material be selected with the requisite size, strength and chemical resistance in order to handle the normal type and volume of container contents, regardless of the type or volume. While a 55-gallon drum has been referenced, the protective liner concept is also applicable to plastic and fiber drums, various containers, bags and boxes.

Another important consideration with this technology is how to secure the liner in position relative to the drum or container so that the liner can be easily attached, the liner bag filled with the desired chemical contents, and thereafter emptied and removed without a risk that the drum or container will become contaminated.

The approach described by Mr. Larson in his article and in his issued U.S. Pat. No. 5,154,308 focuses on a 55-gallon metal, open head drum and the concept of attaching the liner to the center of the lid of the drum. The drum lid is formed with a raised metal boss with an inwardly opening clearance channel or groove into which a drum plug flange is installed. A seal tube welded or soldered to the drum plug flange is used to receive a bag flange with the liner bag attached. A bag support sleeve is disposed around the seal tube and an O-ring is used to retain the EDDL to the drum lid in a way that allows the EDDL to be sealed closed and easily detached from the lid prior to removing the lid from the drum.

In the context of this EDDL system the present flange extension invention is directed to the design of the drum plug flange and seal tube components which are part of the assembly securing the liner to the lid of the drum. The value of the present flange extension invention, other than being suitable for use with the described EDDL system is its lower cost, the elimination of special flange inventories and the ability to withstand the greater heat which may be present during reconditioning of the drums.

The use of disposable liners for containers is known in the art and a variety of designs have been patented over the years. In some instances the liners are flexible and in other designs the liners are more rigid requiring disassembly of the drum for removal. In these earlier patents a variety of flange and fitting designs are disclosed, though none are believed to anticipate the present flange extension invention nor are these earlier patents regarded as being so close as to render the present invention obvious.

The following patents are representative of these earlier patented designs:

| Patent No. | Patentee | Date Issued |
|---|---|---|
| 3,219,230 | Housz, et al. | November 23, 1965 |
| 2,987,216 | Fletcher | June 6, 1961 |
| 2,989,208 | Gibbs, Jr. | June 20, 1961 |
| 3,432,070 | Carpenter, Jr. et al. | March 11, 1969 |
| 4,164,304 | Roberson | August 14, 1979 |
| 4,552,166 | Chadbourne, Sr., et al. | November 12, 1985 |
| 4,635,814 | Jones | January 13, 1987 |
| 4,653,663 | Holtsclaw | March 31, 1987 |
| 4,759,459 | Bailey et al. | July 26, 1988 |
| 4,775,073 | Webb | October, 4, 1988 |
| 4,993,579 | Burchett | February 19, 1991 |
| 5,005,726 | Robbins | April 9, 1991 |
| 5,046,634 | McFarlin et al. | September 10, 1991 |
| 5,056,680 | Sharp | October 15, 1991 |
| 5,154,308 | Larson | October 13, 1992 |
| 3,443,735 | Meijers | May 13, 1969 |
| 2,338,604 | Silveyra | January 4, 1944 |
| 3,167,210 | Carney, Jr. | January 26, 1965 |
| 3,698,595 | Gortz et al. | October 17, 1972 |
| 3,918,605 | Butler | Novemebr 11, 1975 |

SUMMARY OF THE INVENTION

A flange fitting for attaching to the lid of a drum according to one embodiment of the present invention comprises a seal tube having a generally cylindrical main body and an outwardly radiating, frustoconical lip extension and a drum plug flange having a generally cylindrical main body and an outwardly radiating, frustoconical lip, the drum plug flange being sized and shaped to fit within the seal tube such that the lip extension and the lip are generally coextensive with each other.

One object of the present invention is to provide an improved flange fitting for attaching to the lid of a drum.

Related objects and advantages of the present invention will be apparent from the following description.

DESCRIPTION OF THE PREFERRED EMBODIMENT

Figure 1:
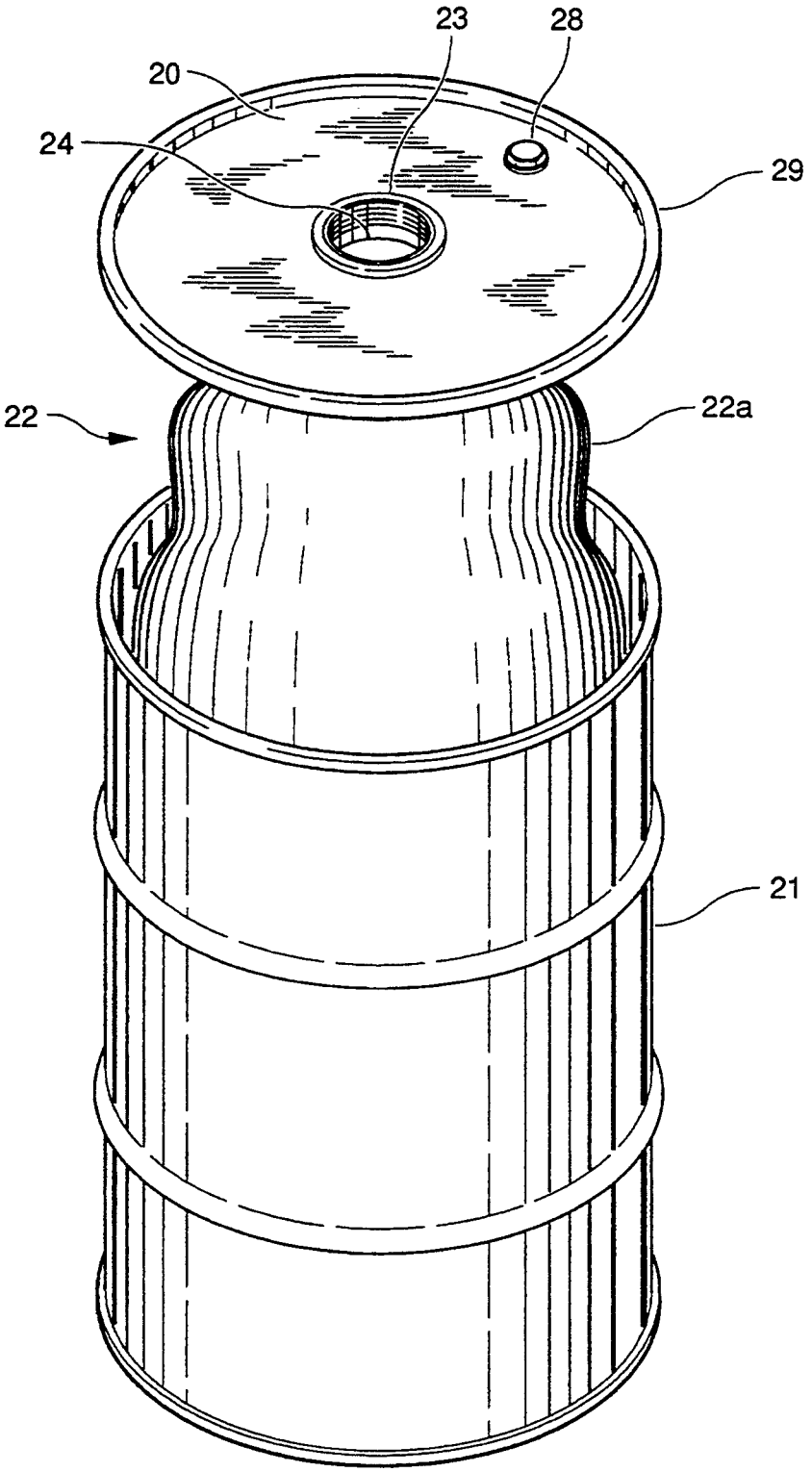
FIG. 1 is a front elevational view of a drum, a drum lid separated from the drum and a detachable drum liner secured to the lid by means of a flange fitting according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a drum lid 20 being lifted off of a 55-gallon metal drum 21 to reveal an externally detachable drum liner (EDDL) 22. The drum liner 22 includes a flexible plastic bag **22*a* which is attached at the center of the drum lid to a raised, generally cylindrical boss 23. Drum liner 22 includes a rigid rim assembly 24 and securing the rim assembly 24 of the drum liner 22 and the lid 20 together is a flange fitting 25 (see FIG. 2). Flange fitting 25 is designed such that the drum liner 22 can be detached from the lid prior to removing the lid from the drum. The drum lid 20 includes a standard ¾" vent plug 28 located in its normal position near the rim 29 of the lid 20**.

The general structure of an earlier EDDL system, not incorporating the present invention, is disclosed in U.S. Pat. No. 5,154,308, issued Oct. 13, 1992 to Larson. This U.S. Patent to Larson is hereby expressly incorporated by reference for its overall disclosure.

Figure 2:
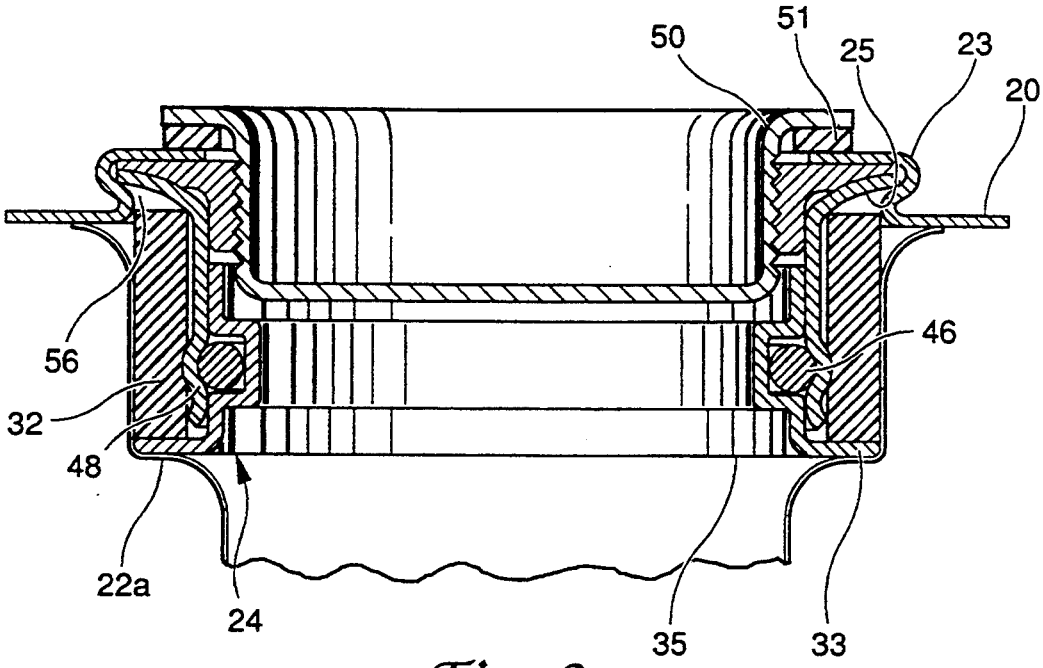
FIG. 2 is a front elevational view in full section of a liner rim assembly assembled to the FIG. 1 flange fitting, showing the liner bag in partial form.

Referring to FIG. 2, the assembly of the drum liner rim assembly 24 and the flange fitting 25 is illustrated in greater detail as a full cross-sectional view. Before describing the particulars of the flange fitting 25 and rim assembly 24, it should first be noted that a generally cylindrical rubber sleeve 32 is employed in the assembly of the drum liner to the raised boss. Sleeve 32 fits around the outer wall surface of flange fitting 25 and functions more as a filler or spacer in order to prevent any portion of the liner bag **22*a* from interfering with the snap fit assembly of the rim assembly 24 and flange fitting 25**.

Figure 3:
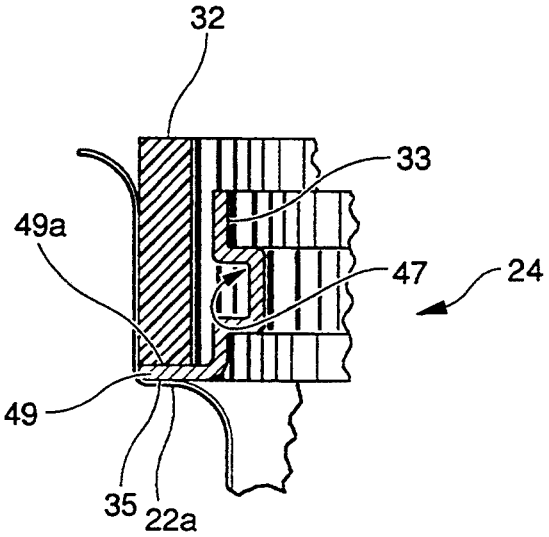
FIG. 3 is a partial, side elevational view in full section of the FIG. 2 liner rim assembly.

Rim assembly 24 includes an annular bag flange 33 including a lower, outwardly radiating underside surface 35 to which bag **22*a* is heat sealed. As is illustrated in FIG. 3, bag 22*a* extends up and across underside surface 35 of bag flange 33 at which point it is heat sealed so as to create a liquid tight and secure assembly of the liner bag 22*a* and bag flange 33. Sleeve 32 has also been illustrated in FIG. 3 simply to show how the outer lip of bag 22*a* extends up and around the outside surface of sleeve 32 thereby spacing it from the remainder of the rim assembly 24 and flange fitting 25**.

Figure 7:
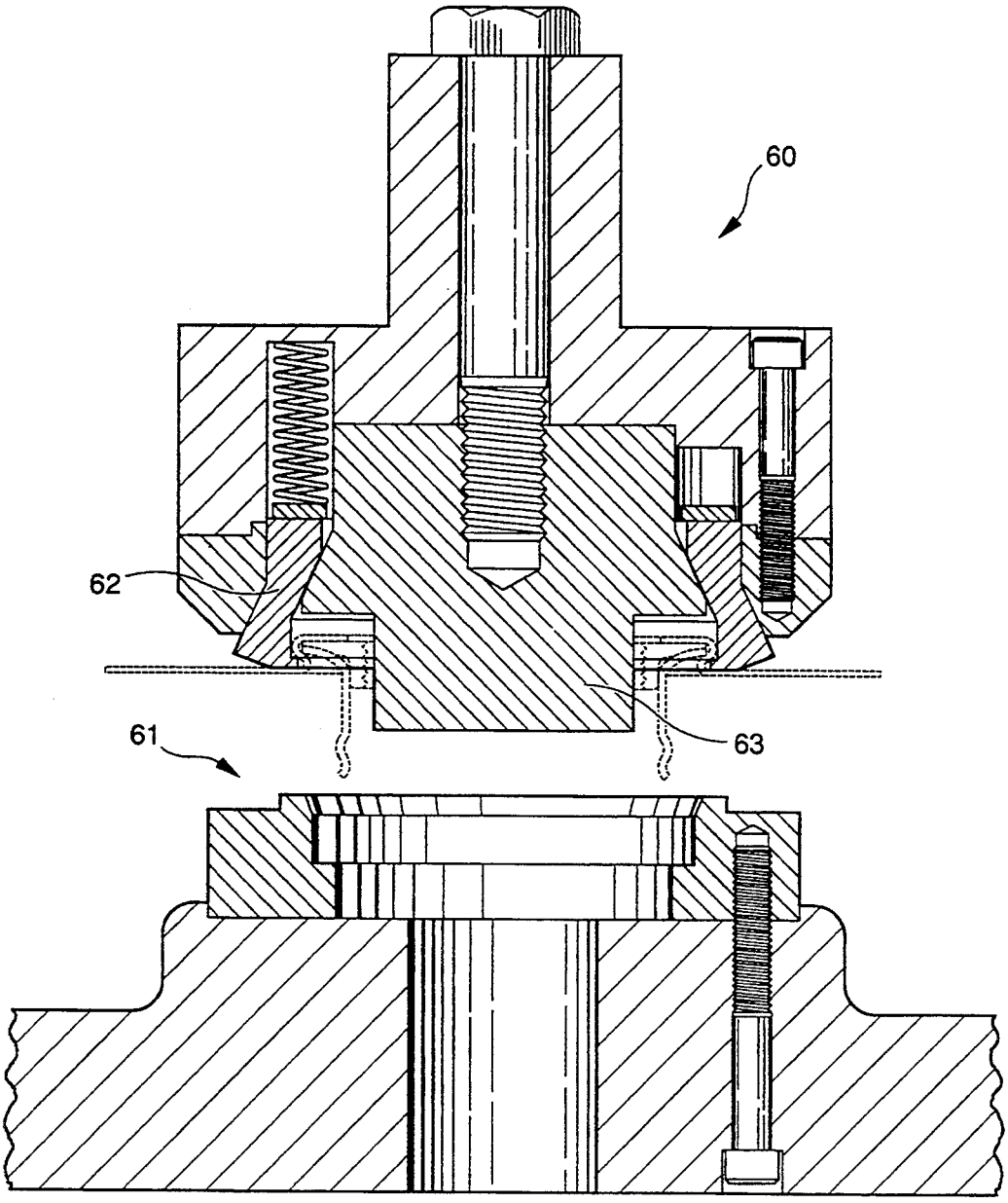
FIG. 7 is a diagrammatical illustration of the punch press operation which securely attaches the flange fitting of the present invention into the drum lid.

The flange fitting 25 (see FIG. 4) includes annular drum plug flange 38 and generally cylindrical seal tube 39. These two members have a generally concentric, close fitting but free relation to each other. The seal tube 39 includes an O-ring channel 40 and a frustoconical lip extension 41. The generally cylindrical main body portion of seal tube 39 is of a unitary construction with the frustoconical lip extension 41. The drum plug flange 38 also includes a generally cylindrical main body portion which is internally threaded for the receipt of a drum plug and is of unitary construction with the main body portion is an upwardly and outwardly radiating frustoconical lip 42. It is to be understood that the flange 38 constitutes what the inventors regard as the normal or standard flange which is typically used with containers and drums of the type illustrated and is typically anchored into the raised boss by a punch press operation including both vertically compression and inwardly directed radial jaws as illustrated in FIG. 7.

Figure 4:
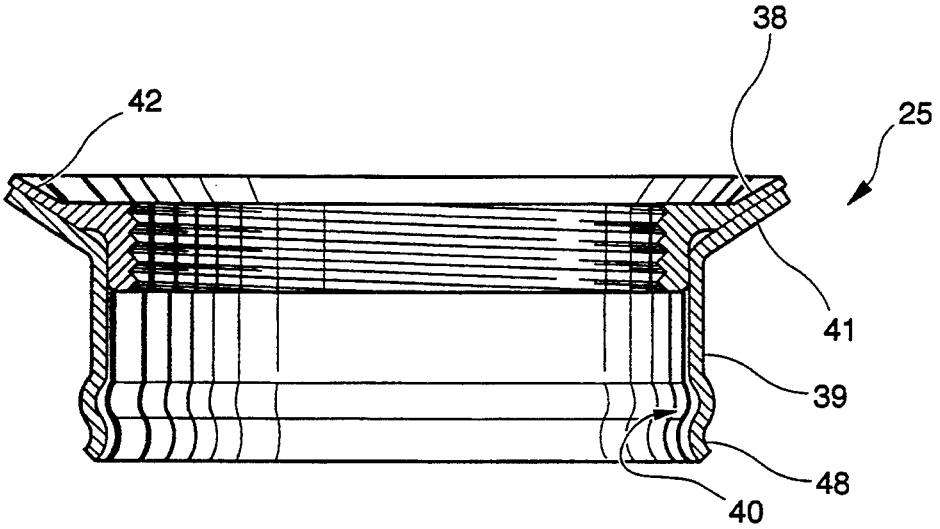
FIG. 4 is a side elevational view in full section of the flange fitting of FIG. 1 according to the present invention.

As is illustrated in FIG. 4, the lip extension 41 is sized and arranged to fit closely up and around the frustoconical lip 42 of the drum plug flange. As illustrated, the lip of the drum plug flange and the lip extension of the seal tube are closely sized to one another with a free, though close fit such that the lip and lip extension are coextensive with each other. In this regard it will also be noted that the upper outer edges of the lip and lip extension are adjacent with really no overlap by either member relative to the other.

According to the present invention, both the drum plug flange and the seal tube will be installed into the inwardly opening channel or recess in the raised boss and by means of the normal punch press operation including both vertical compressive forces and inwardly directed radial clamping forces, these two members will be locked together, simultaneously, into the raised boss. Once this procedure is performed, the drum plug flange 38 and seal tube 39 become firmly locked in place and in effect become an integral part of the steel drum lid.

As should be understood, the use of the mechanical punch press operation can be performed on both the drum plug flange 38 and seal tube 39 without those parts having to be fixed together in some preliminary relationship. These two members do not have to be initially bonded, soldered, welded or otherwise attached to each other. All that is required is that the drum plug flange be set down inside the seal tube so that the frustoconical lip 42 of the flange and the lip extension 41 of the seal tube are oriented so as to be coextensive with each other. It will also be noted that the outer edge of the frustoconical lip is formed with a series of outwardly radiating projections, equally spaced with recess notches inbetween. The radial clamping forces which occur simultaneously with the vertical compressive forces as part of the punch press operation utilize these indentations in order to securely attach the flange and seal tube into the raised boss in a secure manner such that these components are not able to turn or rotate in the raised boss.

Figure 5:
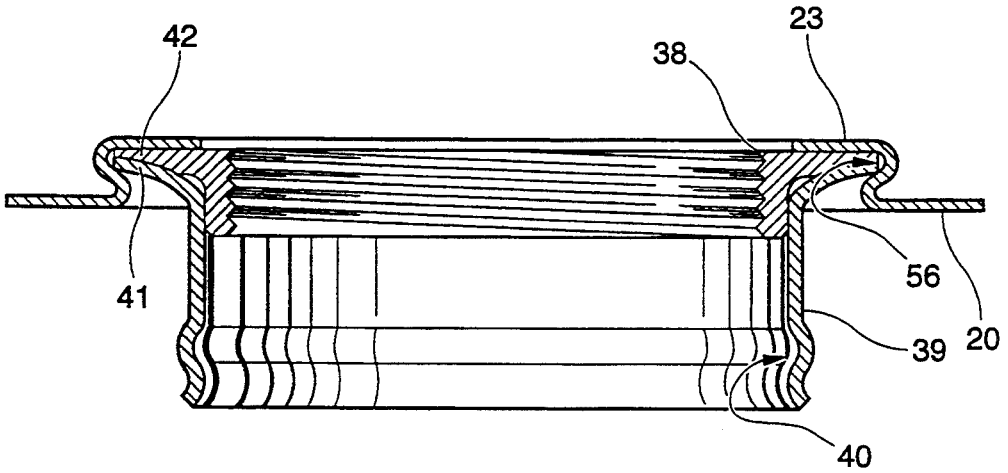
FIG. 5 is a side elevational view in full section of the FIG. 4 flange fitting as installed in the FIG. 1 drum lid, prior to installation of the liner rim assembly.

With the lid of the drum initially removed from the drum, the drum plug flange 38 and seal tube 39 are securely installed into the raised boss by the one-step punch press operation as mentioned. This first assembly step creates the structure that is illustrated in FIG. 5. Another preliminary step which may be performed at any time relative to the timing of the punch press operation is to assemble the bag **22*a* to the bag flange so as to create rim assembly 24. It is of course important to first install the bag support sleeve 32 over the seal tube so that this sleeve will be in position when rim assembly 24 is snapped into position. Although not illustrated in FIG. 3, an O-ring 46 is used to control the assembly and the detachable nature of the rim assembly from the flange fitting. Consequently, O-ring 46 could be regarded as part of rim assembly 24 since the O-ring 46 is installed in the bag flange 33 prior to snapping the rim assembly 24 into the flange fitting 25. As is illustrated, O-ring 46 fits within annular channel 47 (see FIG. 3) which is formed in bag flange 33. As has been illustrated and described, the seal tube 39 includes the O-ring channel ring 40 and the assembly process involves pushing upwardly on the rim assembly, including O-ring 46 so that the outer edge of the O-ring 46 slides along the inside diameter surface of the seal tube until such time as the O-ring 46 encounters the inwardly-open which is adjacent to lower end 48. At this point the O-ring 46 effectively snaps into the O-ring channel 40 and the rim assembly is now assembled to the flange fitting 25**.

As illustrated, the lower, generally cylindrical end 48 of the seal tube extends downwardly below the O-ring 46 but is sized such that the bottom edge of the seal tube does not bottom out on the top surface 49a of lower lip 49 of bag flange 33 before the O-ring 46 snaps into position in O-ring channel 40. Likewise, bag support sleeve 32 has a length in the axial direction which does not interfere with the assembly process.

The next step in the assembly procedure is to assembly the lid onto the drum. The vent plug 28 is opened (removed) and the bag **22*a* is inflated by means of a low pressure, high volume air pump, such as a shop vacuum blower. The bag is sized large enough that the drum contents are restricted only by the drum and not by any portion of the bag. This oversizing of the bag so as to eliminate any loading on the bag and thus any loading on the rim assembly/flange fitting assembly is important because the only assembly feature which holds the bag in position is the interfit of the O-ring 46 between the O-ring channel 40 in the seal tube and the O-ring channel 47 in the bag flange 33**. After the bag is inflated, the vent plug is closed (installed) and the drum is ready to be filled.

Figure 6:
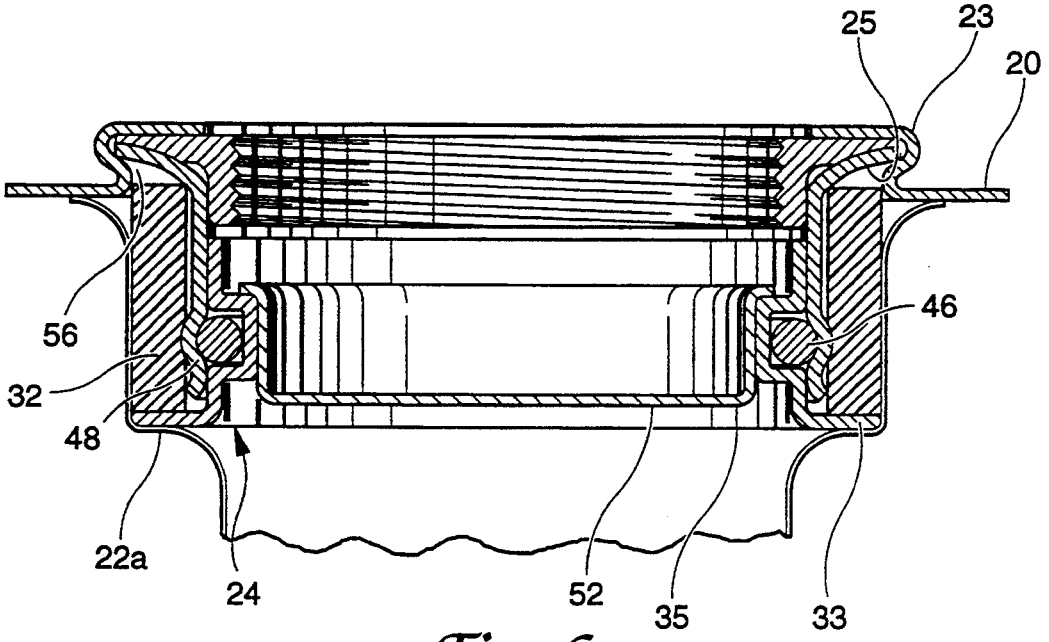
FIG. 6 is a side elevational view in full section of the FIG. 2 liner and lid assembly with the drum plug removed and a bag plug installed.

As illustrated in FIG. 2 an externally threaded drum plug 50 is received by the internal threads of the drum plug flange 38 in order to seal the drum closed after filling. Gasket 51 provides additional security for the seal. Plug 50 provides the means of opening and closing the drum as some or all of the drum contents are required. Once the drum is empty, the drum liner (EDDL) is sealed closed with a bag plug 52, see FIG. 6. The drum liner can then be detached from the flange fitting by exerting a downward force of approximately 45 pounds around the upper, outer edge of the bag plug 52. The exerted forces on the bag plug 52 press down on the upper edge of the O-ring channel 47 causing the bag flange 33 to come out of engagement with the seal tube. The result is that the rim assembly including the O-ring 46 will be disassembled and actually detached from the flange fitting. Consequently, the drum liner will be detached from the drum lid and is effectively free within the drum 21.

The next step is to remove the drum lid from the drum and then dispose of the contaminant-residue trapped in the liner bag **22*a* as the entire liner 22 is discarded. The lid 20 and drum 21** are then ready to receive a new liner with the same snap fit O-ring assembly technique. Thus the drum can be used and reused and reused, without the risk of chemical or hazardous waste contamination. Disposing of 100 liners as compared to 100 drums results in a dramatic decrease in hazardous waste and a dramatic decrease in storage or landfill requirements.

The design efficiency provided by flange fitting 25 is the focus of the present invention. The original design for the flange fitting used a roll formed seal tube soldered (or welded) to a standard drum flange. The standard drum flange was then mechanically affixed to the drum head (raised boss) by the normal or conventional punch press operation. The raised boss includes an inwardly opening recess 56 into which the flange lip is installed. According to the original design approach, the upper outwardly extending lip of the standard drum flange would be anchored in position within the annular recess 56 by both vertical compression during the punch press operation while at the same time five radially positioned jaws press inwardly so as to securely lock the metal of the raised boss of the lid in and around the various projections and recesses in the outer edge of the flange lip. It is acknowledged that this earlier design and the corresponding punch press operation are conventional and typical of what has been done with this type of standard drum flange for a number of years.

With regard to using this concept in combination with the disclosed externally detachable drum liner (EDDL), it was necessary to provide and to assemble some type of seal tube which could be used to provide O-ring channel 40. While there was no need or desire to change the standard flange, nor was there any desire to change the flange installation procedure so that the existing punch press tooling and dies could be used, certain disadvantages were noticed with regard to the original design for the seal tube. First, the original design for the seal tube involved simply a generally cylindrical sleeve and there was no lip extension. Consequently, the seal tube had to be attached to the drum plug flange by some means and the method selected was welding or soldering in order to initially join these two components together so that the seal tube would have a secure and fixed relationship to the drum plug flange and the drum plug flange would then be anchored into the raised boss. This welding or soldering step for joining the seal tube and drum flange together had to be performed before a drum manufacturer would assemble the drum plug flange to the drum lid. Since drum manufacturers prefer not to perform this welding or soldering step and since many of the drum manufacturers are not equipped to perform this step, this original design resulted in a double inventory of drum flanges. Two styles needed to be stocked by the drum manufacturer, one inventory of the conventional drum plug flange for use with standard drum lids and a second inventory of specially welded or soldered flange and seal tube assemblies for use with drum lids intended for use with the EDDL system. It should be understood that the drum manufacturers will produce a wide range and variety of drums with different features and design styles. Consequently, since any one drum manufacturer might be producing a number of non-EDDL drums as well as a number of EDDL drums, it would be necessary to have the standard drum plug flange available both as a single component and as a welded assembly.

Another disadvantage of the original design approach pertains to the material thickness needed for the seal tube and the fact that tube stock had to be used. The tube stock used is rolled and a bulging die is used to create the O-ring channel 40. This tube stock is substantially thicker than what is used in the present invention, having a wall thickness of approximately 0.060 inches or slightly thicker. This thickness of material is necessary because of the welding step and a concern about warpage of the steel tube and flange. With thicker material there is less risk of warpage to an unacceptable level. Warpage of the seal tube might also warp or distort the drum plug flange which could affect the internal threads. Warpage of the seal tube might also affect the degree of cylindricity of the seal tube and the ability of the O-ring channel 40 to properly receive the O-ring 46 in order to assemble the rim assembly 24 into the flange fitting. A third concern, though one also related to the temperature level, pertains to reconditioning of the drums. Reconditioning of a drum typically exposes the lid and the assembled seal tube and flange to temperatures in the range of 500°-900° F. If solder is used as the "welding" medium in order to join the seal tube and flange together, the solder softening temperature in the range of 400°-450° F. would present a problem during drum reconditioning. These temperature ranges would mean that during reconditioning the soldered joint would loosen or break free requiring another process step to resolder the seal tube and flange back together. Obviously this problem could be avoided by going back to a welded joint, but here again in order to prevent the undesirable and conceivably unworkable warpage it is important that a relatively thick wall be used for the seal tube.

The present invention provides improvement in the design of the flange fitting assembly by eliminating any welding or soldering step and simply crimping both the seal tube 39 and drum plug flange 38 into the raised boss 23, simultaneously by a single punch press operation. The present invention still uses the standard drum plug flange and thus drum manufacturers can stock a single flange for both EDDL drums and for non-EDDL drums.

The seal tube is now able to be made of thinner sheet stock material and stamped out of the sheet stock prior to forming. A typical wall thickness for this sheet stock for the seal tube of the present invention is 0.028 inches. The O-ring channel 40 can be formed into the sheet stock and a bulging die is not required. Reconditioning temperatures are not a factor with this new design according to the present invention as there is no solder to soften and warpage is not a concern since welding temperatures are not present.

The key feature of the present invention which is different from the original design approach is to modify the seal tube from a generally cylindrical member to a combination of a generally cylindrical member with an integral, upwardly and outwardly radiating frustoconical lip extension 41 which is sized and shaped to fit closely around and conform to the size and shape of flange 38 and in particular to the frustoconical lip 42 of flange 38. These two overlapping and aligned lips (lip extension 41 and lip 42) are installed together, though as loose pieces, into the annular recess 56 of the raised boss 23. The lip 42 and lip extension 41 are positioned in contact with each other and are sized and shaped so as to be coextensive with each other. The punch press operation of FIG. 7 is then performed securely clamping the flange and seal tube simultaneously into the raised boss of the drum lid 20.

The punch press set up includes a movable male portion 60 and a stationary female portion 61. Located as part of the male portion are a total of five crimping arms 62 which are equally spaced around male portion 60. Each arm 62 is spring biased and has a geometry and orientation which results in radially inward movement as the male portion advances. These arms must move inwardly to create clearance for the arms to move upwardly as the male portion advances.

Central die 63 compresses the top surface of the raised boss 23 so as to crimp the lip 42 and lip extension 41 into the open recess 56. As this action occurs, the five arms push inwardly so as to create an underside surface of the raised boss around the lip and lip extension. This underside crimping action of the arms also crimps the metal of the raised boss 23 into and around the various projections and recesses in the flange lip.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In combination:

a drum lid having a raised boss;

a seal tube having a generally cylindrical main body and an outwardly radiating, frustoconical lip extension; and a drum plug flange laving a generally cylindrical main body and an outwardly radiating, frustoconical lip, said drum plug flange being sized and shaped to fit within said seal tube such that said lip extension axed said lip are generally coextensive with each other, said lip and said lip extension are each received by said tightly secured within said raised boss.

2. The flange fitting of claim 1 wherein the main body of said seal tube includes an O-ring channel adapted to be used for snap fit receipt of a drum liner.

3. The flange fitting of claim 2 wherein the main body of said drum plug flange is internally threaded for receipt of an externally threaded drum plug.

4. The flange fitting of claim 3 wherein said seal tube is made from a stamping out of sheet metal stock.

5. The flange fitting of claim 1 wherein the main body of said drum plug flange is internally threaded for receipt of an externally threaded drum plug.

6. The flange fitting of claim 1 wherein said seal tube has a generally uniform wall thickness measuring less than 0.030 inches.

* * * * *

UNITED STATES PATENT AND TRADEMARK OFFICE

CERTIFICATE OF CORRECTION

PATENT NO. : 5,379,913

DATED : January 10, 1995

INVENTOR(S) : Todd M. Rieke, et al.

It is certified that error appears in the above-identified patent and that said Letters Patent is hereby corrected as shown below:

Title page,
In the Abstract, item [57], at the third line, delete "arid" and substitute --and--.

In Column 5, at line 12, insert --O-ring channel 40--after "inwardly-open".

In Column 8, at line 35, delete "laving" and substitute --having--.

In Column 8, at line 39, delete "axed" and substitute --and--.

In Column 8, at line 41, delete "said" 1st occurrence and substitute and--.

Signed and Sealed this

Eighteenth Day of April, 1995

Bruce Lehman

*Attest:*

BRUCE LEHMAN

*Commissioner of Patents and Trademarks*

*Attesting Officer*